US009091405B2

(12) United States Patent
Ho

(10) Patent No.: US 9,091,405 B2
(45) **Date of Patent: *Jul. 28, 2015**

(54) LIQUID MOTION LAMP HOLDER IMPROVEMENT

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 183 days.

This patent is subject to a terminal disclaimer.

(21) Appl. No.: 13/803,729

(22) Filed: Mar. 14, 2013

(65) Prior Publication Data

US 2014/0268675 A1 Sep. 18, 2014

(51) Int. Cl.

| | |
|---|---|
| ***F21V 21/06*** | (2006.01) |
| ***F21S 10/00*** | (2006.01) |
| ***F21V 17/00*** | (2006.01) |
| *F21V 9/12* | (2006.01) |
| *F21W 121/00* | (2006.01) |
| *A47G 19/22* | (2006.01) |
| *F21S 6/00* | (2006.01) |
| *G09F 13/24* | (2006.01) |

(52) U.S. Cl.

CPC ..... *F21S 10/002* (2013.01); *F21V 17/002* (2013.01); *A47G 19/2255* (2013.01); *F21S 6/002* (2013.01); *F21V 9/12* (2013.01); *F21W 2121/00* (2013.01); *G09F 13/24* (2013.01)

(58) Field of Classification Search

CPC ..... F21S 10/002; F21S 6/002; F21V 21/06; F21V 9/12; F21W 2121/00; G09F 13/24; A47G 19/2255

USPC ..... 362/101, 96, 811, 318, 806, 644

See application file for complete search history.

(56) References Cited

U.S. PATENT DOCUMENTS

| | | | | |
|---|---|---|---|---|
| 6,585,387 | B1 * | 7/2003 | Lee | 362/96 |
| 7,798,665 | B2 * | 9/2010 | Yang | 362/101 |
| 8,141,284 | B2 * | 3/2012 | Yang | 40/737 |
| 8,746,913 | B2 * | 6/2014 | Tsai | 362/101 |
| 2003/0202340 | A1 * | 10/2003 | Wu | 362/101 |
| 2014/0003035 | A1 * | 1/2014 | Tsai | 362/101 |
| 2014/0003036 | A1 * | 1/2014 | Ho | 362/101 |
| 2014/0268674 | A1 * | 9/2014 | Ho | 362/101 |

* cited by examiner

*Primary Examiner* — Anh Mai
*Assistant Examiner* — Arman B Fallahkhair
(74) *Attorney, Agent, or Firm* — Rosenberg, Klein & Lee

(57) ABSTRACT

The invention relates to a liquid motion lamp holder improvement, comprising: a holder having a base, a first mounted seat, a second mounted seat, a support bracket connecting to a lower end of the holder and the second mounted seat, transparent bottle having at least two immiscible substances therein and arranged between the first mounted seat and second mounted seat; and at least a joint sleeve mounted on an end of the transparent bottle for securely positioning on the vertical axis of the base. Whereby the transparent bottle turns into liquid motion lamp visual effect through a projected light of an LED bulb at a bottom of the first containing room and can be moved along the vertical axis of the base up and down for easily installed and removed between the first mounted seat and second mounted seat.

10 Claims, 10 Drawing Sheets

LIQUID MOTION LAMP HOLDER IMPROVEMENT

BACKGROUND OF THE INVENTION

1. Field of the Invention

The invention relates to a liquid motion lamp holder improvement, particularly to a bulb projected to become visual effect of the liquid motion lamp and to a transparent bottle to be easily installed and removed.

2. Description of the Related Art

Since the sixties of the last century, lava lamps have become a common device in the worldwide university student dormitories and teenage children bedrooms. Lava lamps have been deeply implanted into the popular culture of the United States and many other countries.

With reference to FIG. 1, U.S. Pat. No. 3,570,156 discloses a lava lamp display device 60 comprising: a glass vessel 61 having a bottom 62 arranged in a hollow conical metallic seating 63 and located on an electric light bulb 64. Moreover, the glass vessel 61 has two immiscible substances. For example, the first substance is liquid 65 and the second substance is paraffin 66 which has a higher density than the liquid 65 at room temperature and a lower density than the liquid 65 after heating. After the electric light bulb 64 is turned on, the paraffin 66 in the bottom 62 of the glass vessel 61 is heated and flows in the liquid 65. At the same time, the electric light bulb 64 projects the light in the glass vessel 61, forming a lighting effect and becoming decorations at home and office. The solid paraffin requires a long time for heating to melt while suspended in the liquid. Therefore, in recent practice, the second substance is set to be a solid or liquid and the specific gravity value thereof is similar to the liquid of the first substance such that the lava lamp has a dynamic function via the short heating time. Such improvement and the aforesaid lava lamp structure are so called liquid motion lamp.

The principle of the liquid motion lamp is to provide a heat from a bulb for the liquid of first substance within the container to produce convection for the second floating substance in the liquid to be moved up and down with the liquid. Under the illumination of the projection light, the floating objects float and sink, producing brilliant and vivid visuals.

However, the transparent container without stable installation structure is easily overturned and broken, which allows the internal liquid to harm human body. Therefore, the present invention is provided for enhancing the stability and safety of the liquid motion holder and the convenience of the installing and removing the transparent bottle.

SUMMARY OF THE INVENTION

It is the first primary object of the present invention to provide a stable liquid motion lamp holder structure to avoid a transparent container overturning and falling apart which is able to harm human body by flowing-out liquid of the transparent container.

It is the second object of the present invention to provide a lamp holder structure for a transparent bottle and bulb of the liquid motion lamp to be easily installed and removed for increasing the convenience and security effects.

In order to achieve the above objects, the liquid motion lamp holder improvement comprises: a holder having a base on a bottom thereof; a first mounted seat having a bottom mounted on the base and a first containing room with an upward opening at an inner periphery thereof; a second mounted seat arranged on a top of the holder and having a second containing room with a downward opening at an inner periphery thereof and the second containing room having a containing height of at least 5 cm; a support bracket having an end connecting to a lower end of the holder and another end connecting to the second mounted seat for centers of the first mounted seat and second mounted seat to be vertically located on an axis of the base, being in an up-down corresponding state; a projecting light source including a first lamp seat mounted in the first containing room of the first mounted seat and a bulb mounted on the first lamp seat; a transparent bottle arranged between the first mounted seat and second mounted seat and having two immiscible substances therein and an inserted section at a lower end thereof and the inserted section having an external diameter slightly smaller than an external diameter of the transparent bottle; and at least a joint sleeve having a hollow containing room at an inner periphery thereof and mounted on an end of the transparent bottle and the transparent bottle having an upper end for moving upward to the second containing room to a predetermined height and the inserted section for moving downward to the first containing room and an extended height formed at an end of the transparent bottle by the joint sleeve so that the transparent bottle is securely positioned between the second containing room and first containing room.

Whereby the transparent bottle turns into liquid motion lamp visual effect through the projecting light source; the design of the second containing room allows an end of the transparent bottle to be moved in the containing height along the vertical axis of the base up and down for the transparent bottle to be easily installed and removed between the first mounted seat and second mounted seat.

DETAILED DESCRIPTION OF THE PREFERRED EMBODIMENT

Figure 1:
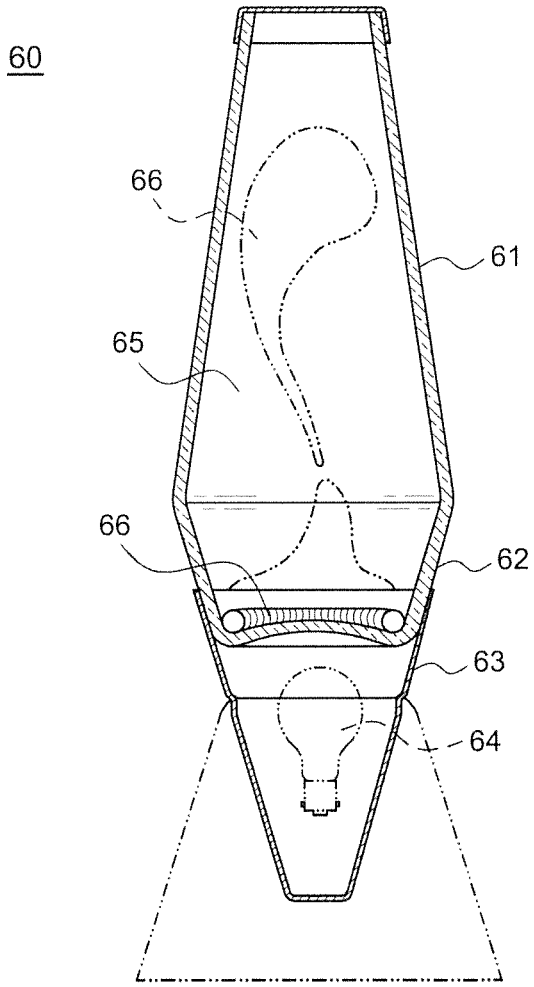
FIG.1 PRIOR ART
FIG. 1 is a schematic view of a conventional lava lamp.
Figure 2:
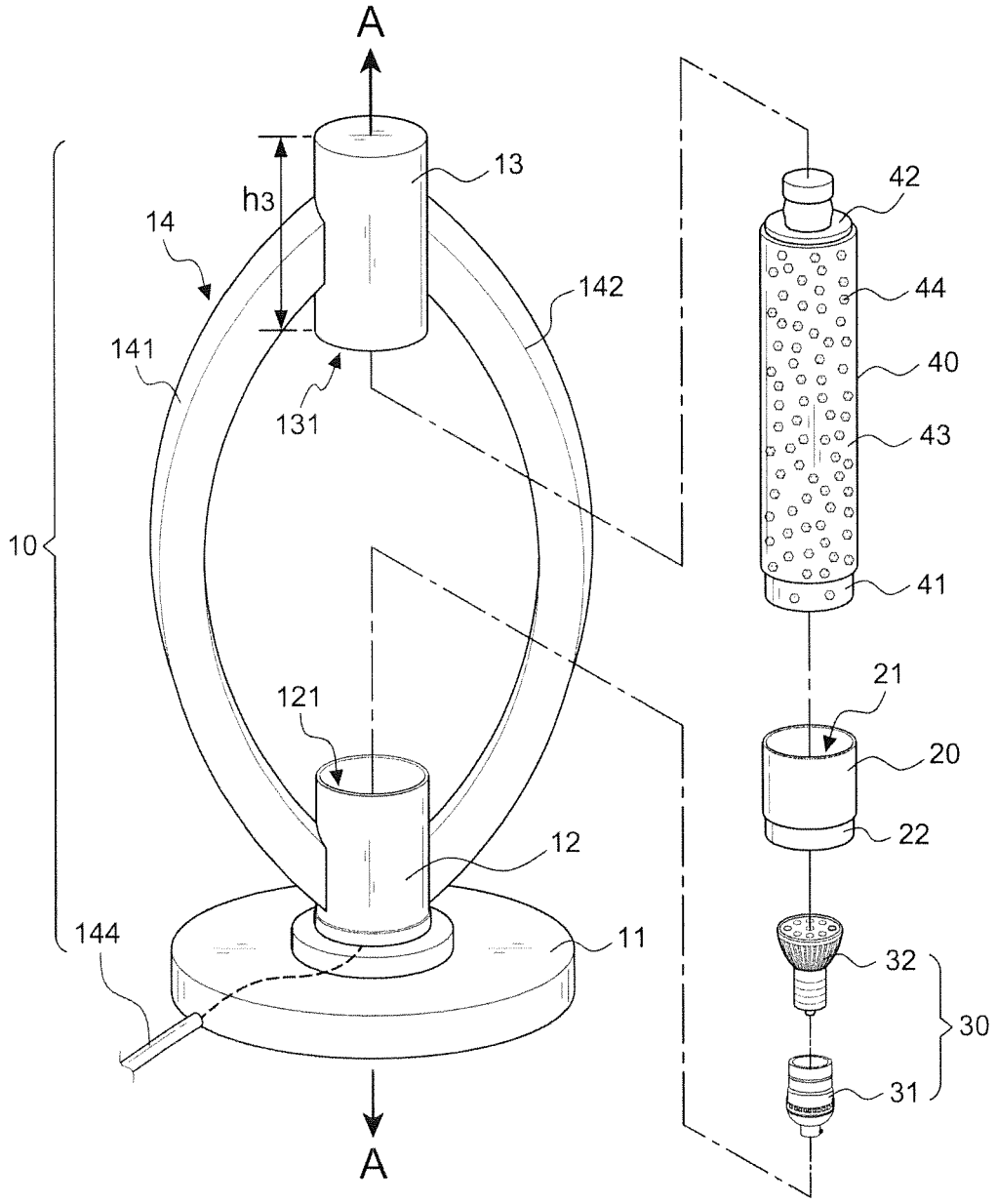
FIG. 2 is an exploded perspective view of a preferred embodiment in accordance with the present invention.
Figure 3:
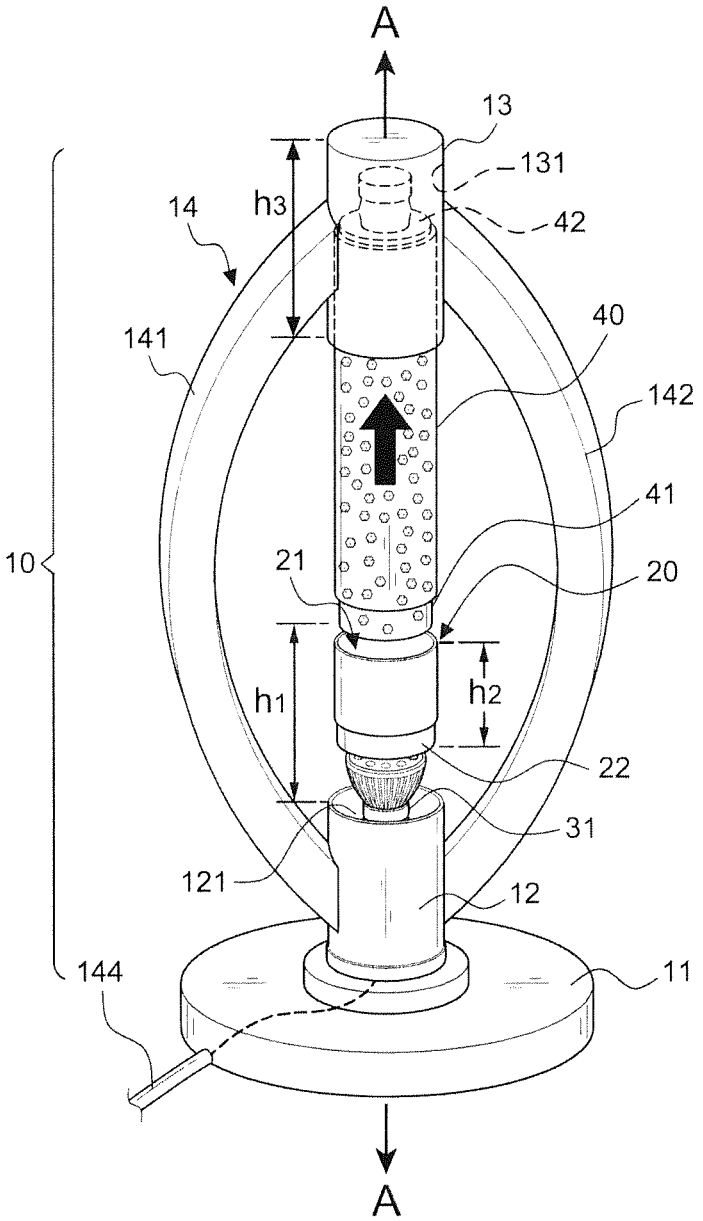
FIG. 3 is a schematic view of a preferred embodiment in accordance with the present invention, illustrating the design of a containing height.

Referring to FIGS. 2 and 3, the preferred embodiment of a liquid motion lamp holder improvement in accordance with the present invention comprises: a holder 10 having a base 11 on a bottom thereof for placing on a ground or desktop; a first mounted seat 12 having a bottom mounted on the base 11 and a first containing room 121 with an upward opening at an inner periphery thereof; a second mounted seat 13 arranged on a top of the holder 10 and having a second containing room 131 with a downward opening at an inner periphery thereof and a containing height h3 of at least 5 cm; a support bracket 14 having an end connecting to a lower end of the holder 10 and another end connecting to the second mounted seat 13 for centers of the first mounted seat 12 and second mounted seat 13 to be vertically located on an axis A-A of the base 11, being in an up-down corresponding state.

With the reference to FIG. 2, a projecting light source 30 as a heat source and illumination includes a first lamp seat 31 is mounted in the first containing room 121 of the first mounted seat 12 and the bulb 32 mounted on the first lamp seat 31. In the embodiment, the bulb 32 is an LED bulb but it is not a limitation. Moreover, a transparent bottle 40 is arranged between the first mounted seat 12 and the second mounted seat 13 and includes at least two immiscible substances therein and an inserted section 41 at a lower end thereof. The inserted section 41 has an external diameter slightly smaller than an external diameter of the transparent bottle 40 for quick positioning. In the embodiment, the first substance is a solution 43 mixed with calcium nitrate and water and the second substance is a plurality of paillette having similar specific gravity with the solution 43 but it is not a limitation. It is applicable for only if the second substance is suspended in the first substance and it is a prior art and thus will not be described in details here.

With the reference to FIG. 2, a joint sleeve 20 includes an inserted section 22 at a lower end thereof for inserting into the first containing room 121 of the first mounted seat 12 and an external diameter of the inserted section 22 is lightly smaller than an external diameter of an upper end of the joint sleeve 20. The joint sleeve 20 has a hollow containing room 21 at an inner periphery thereof and mounted on a lower end of the transparent bottle 40 and the transparent bottle 40 has an upper end 42 for moving upward to the second containing room 131 to a predetermined height and the inserted section 41 for moving downward to the first containing room 121 and an extended height is formed at an end of the transparent bottle 40 by the joint sleeve 20 so that the transparent bottle 40 is securely positioned between the second containing room 13 and first containing room 12.

Whereby the transparent bottle 40 turns into liquid motion lamp visual effect through a projected light of the LED bulb 32. Due to the design of the containing height h3 of the second containing room 131, the upper end 42 of the transparent bottle 40 can be vertically moved in the containing height h up and down such that the transparent bottle 40 is easily installed and removed between the first mounted seat 12 and second mounted seat 13.

Figure 4:
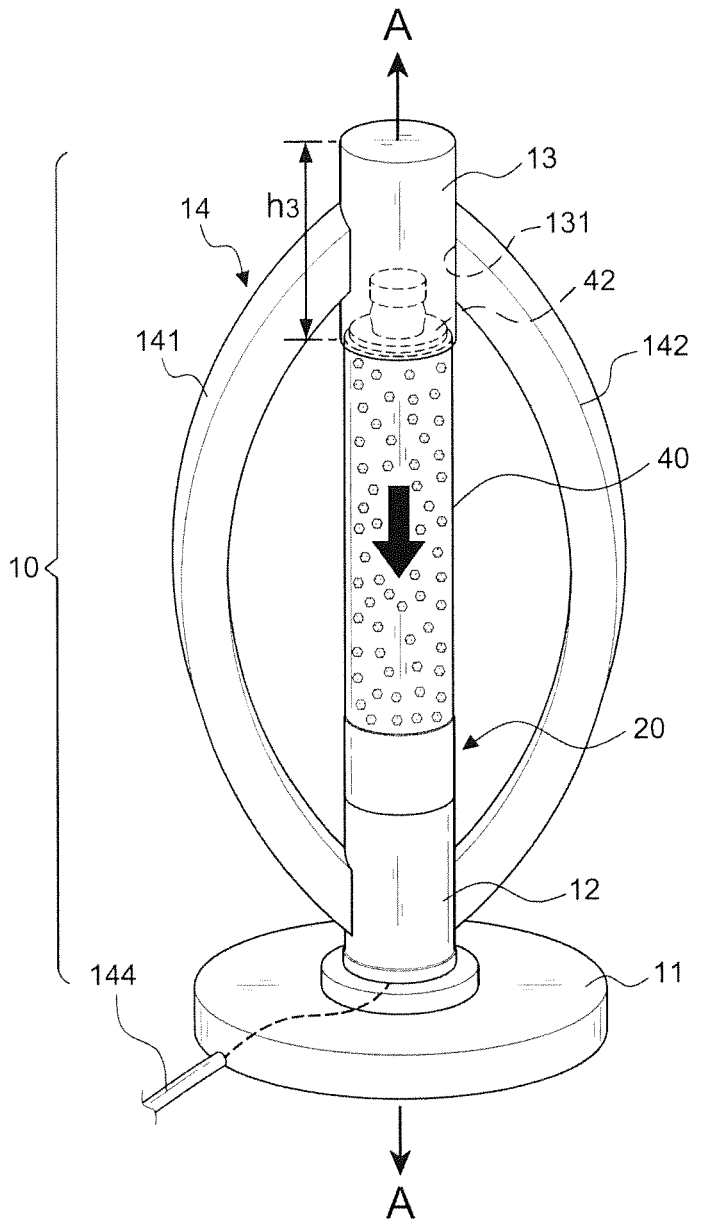
FIG. 4 is a schematic view of a preferred embodiment in accordance with the present invention, illustrating a transparent bottle in an installation state.

With the reference to FIG. 3, the upper end 42 of the transparent bottle 40 is first penetrated into the second containing room 131 of the second mounted seat 13 for having a height h1 between the lower end of the transparent bottle 40 and the upper end of the first mounted seat 12, which is taller than a height h2 of the joint sleeve 20. Then, the joint sleeve 20 is penetrated into the inserted section 41 of the transparent bottle 40 and the transparent bottle 40 together with the joint sleeve 20 is inserted into the first containing room 121 of the first mounted seat 12. Due to the upper end 42 of the transparent bottle 40 in the second containing room 131 and the inserted section 22 of the joint sleeve 20 in the first containing room 121, the transparent bottle 40 as shown in FIG. 4 is securely mounted between the first mounted seat 12 and second mounted seat 13.

Figure 5:
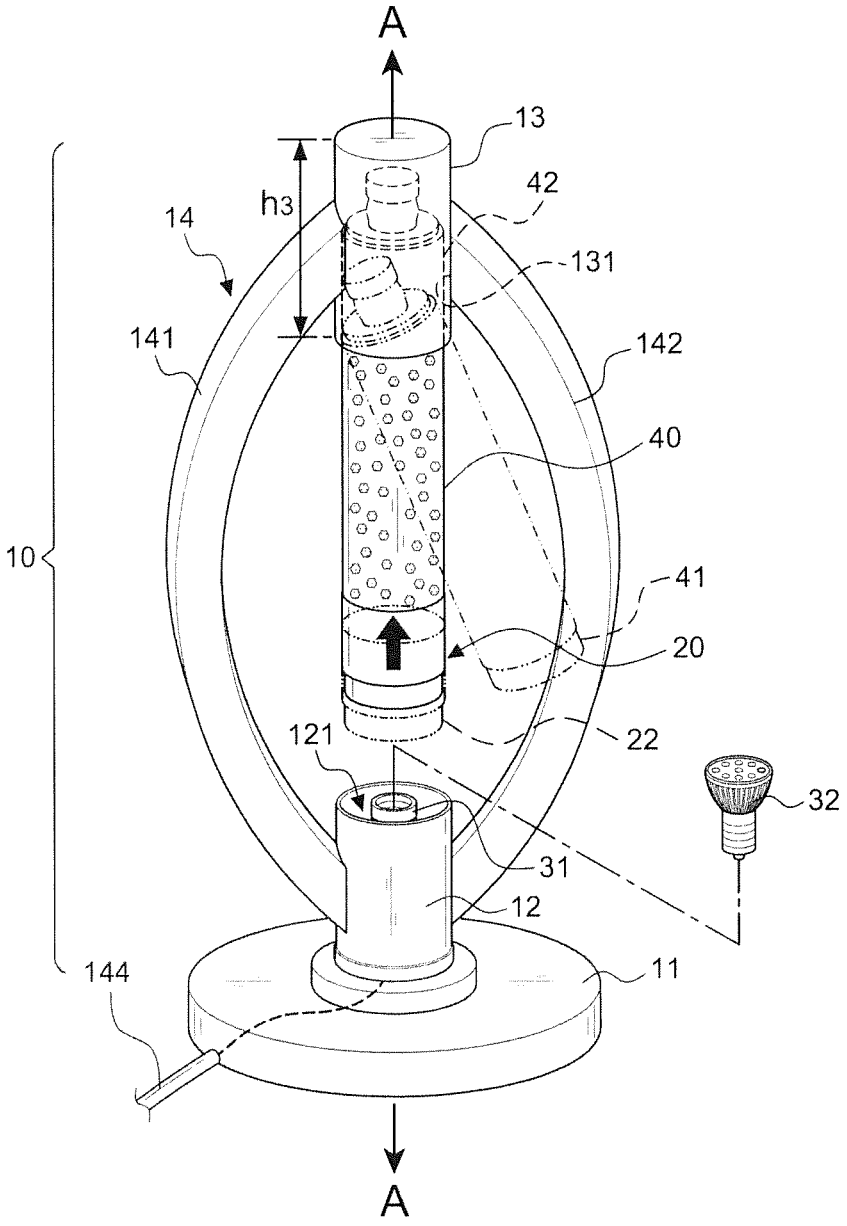
FIG. 5 is a schematic view of a preferred embodiment in accordance with the present invention, illustrating a transparent bottle in a disassembly state.

FIG. 5 illustrates the disassembly of the LED bulb 32 or the transparent bottle 40. The first step is to axially move the transparent bottle 40 as well as the joint sleeve 20 upward until the upper end 42 of the transparent bottle 40 goes deep to the containing height h3 of the second containing room 131 and the inserted section 22 of the joint sleeve 20 completely detaches from first containing room 121 of the first mounted seat 12; the second step is to remove the joint sleeve 20 from the lower end of the inserted section 41 of the transparent bottle 40; the third step is to move the transparent bottle 40 downward until the upper end 42 close to the bottom end of the second containing room 131 and then continue downward moving at an angle until the transparent bottle 40 completely detached from the second mounted seat 13. The user can not only change the transparent bottle 40 but the LED bulb 32 by the above-mentioned steps.

Figure 6:
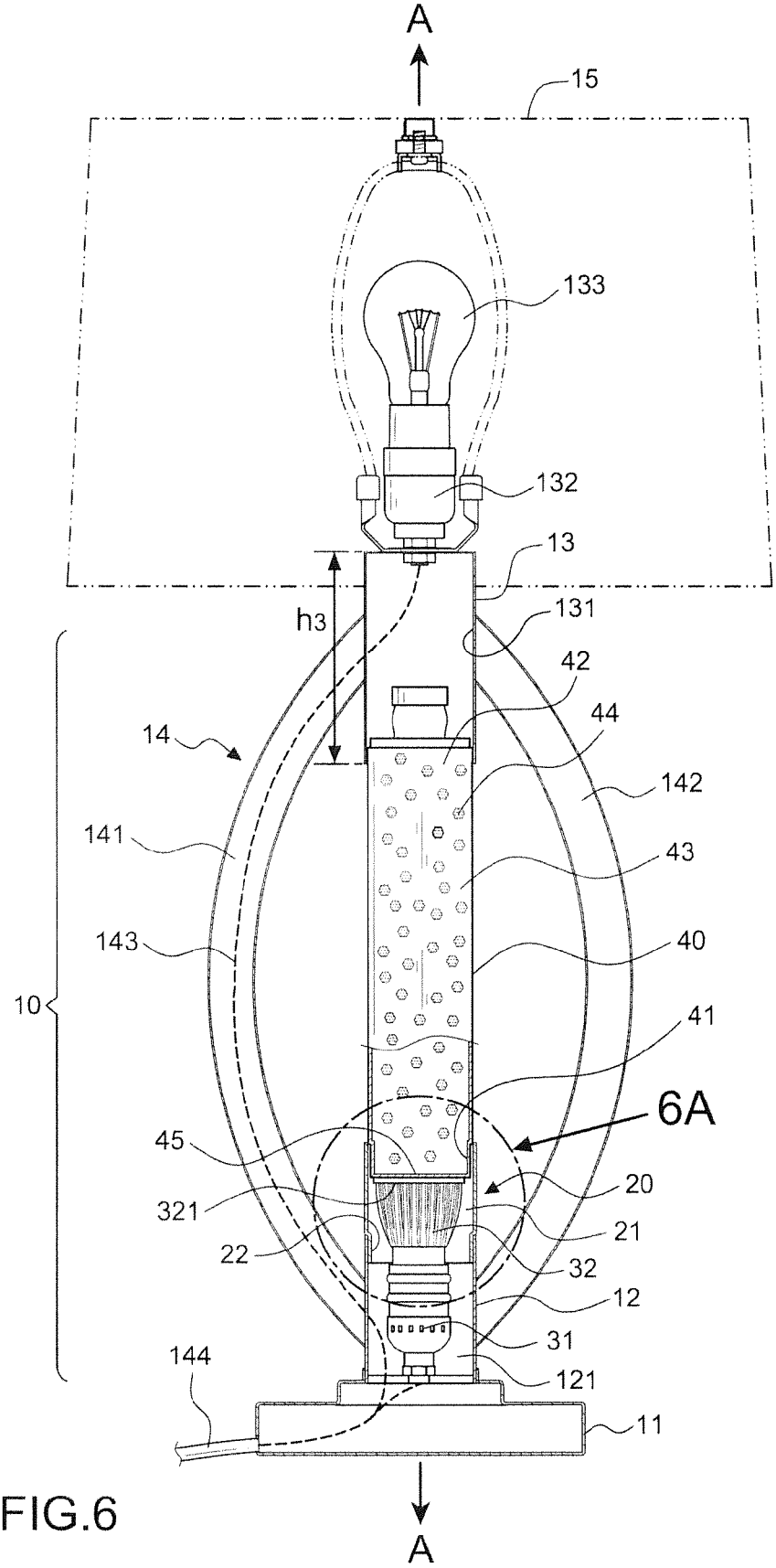
FIG. 6 is a sectional view of the first preferred embodiment in accordance with the present invention, illustrating in an assembly state.
Figure 6A:
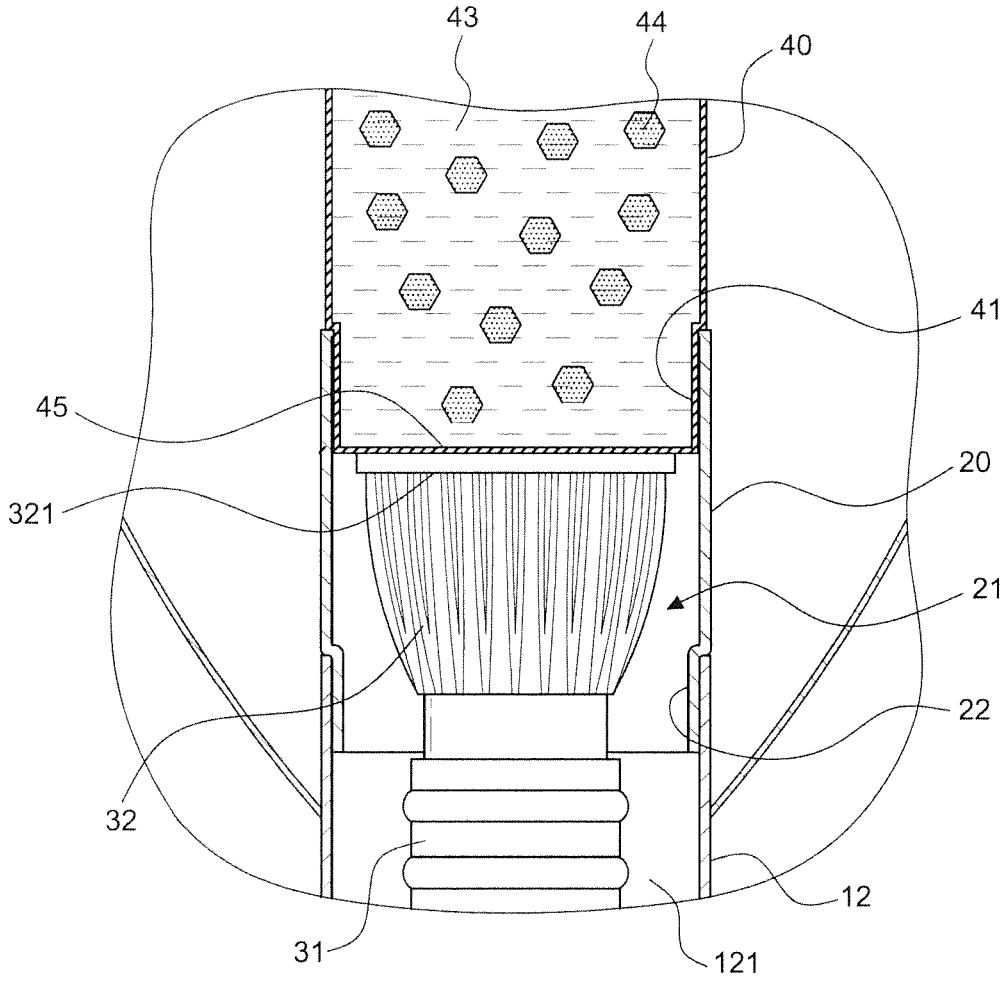
FIG. 6A is an enlarged sectional view of 6A in FIG. 6.

With the reference to FIGS. 6 and 6A, the transparent bottle 40 is mounted between the first mounted seat 12 and the second mounted seat 13 by the joint sleeve 20. That is, the inserted section 22 of the joint sleeve 20 is inserted into the first containing room 121 of the first mounted seat 12 and the inserted section of the transparent bottle 40 is inserted into the hollow containing room 21 of the joint sleeve 20. At the same time, the transparent bottle 40 has a bottom surface 45 connected to a top surface 321 of the LED bulb 32 for directly conducting the heat of the LED bulb 32 to the transparent bottle 40. In the first preferred embodiment as shown in FIG. 6, the support bracket 14 in an elliptical shape is composed of symmetrical hollow left arc-shaped tube 141 and right arc-shaped tube 142 and includes a lower end fixed on an external side of the first mounted seat 12 and upper end fixed on an external side of the second mounted seat 13 so that the centers of the first mounted seat 12 and second mounted seat 13 are vertically located on an axis A-A of the base 11. In the embodiment, the present invention has a second lamp seat 132 on a top of the second mounted seat 13 for mounting a lighting lamp 133 for lighting, a lampshade 15 arranged on the lighting lamp 133 and a wire 143 arranged in the left arc-shaped tube 141 for connecting to the second containing room 132 and a power cord 144.

Figure 7:
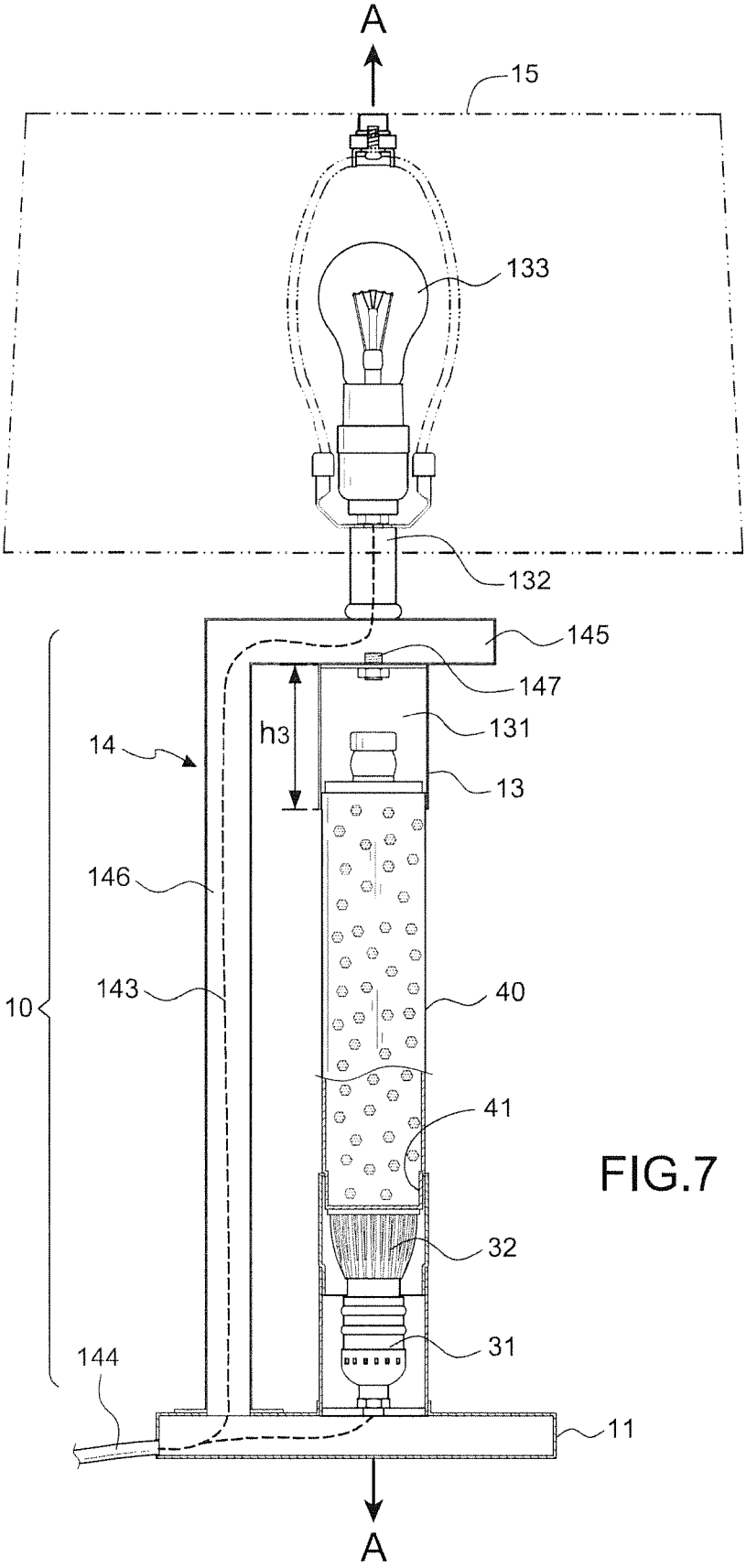
FIG. 7 is a sectional view of the second preferred embodiment in accordance with the present invention, illustrating in an assembly state.

FIG. 7 illustrates the second preferred embodiment that the support bracket 14 in an inverted L-shaped is composed of a hollow transverse tube 145 and vertical tube 146. The vertical tube 146 has a lower end fixed on an upper side of the base 11 and the second lamp seat 132 is arranged on the top of the transverse tube 145. Moreover, the second mounted seat 13 has an upper end fixed on an lower end of the transverse tube 145 by a screw 147 so that the centers of the first mounted seat 12 and second mounted seat 13 are vertically located on an axis A-A of the base 11 and the wire 143 is arranged in the transverse tube 145 and vertical tube 146 for connecting to the lighting lamp 133 and a power cord 144.

Figure 8:
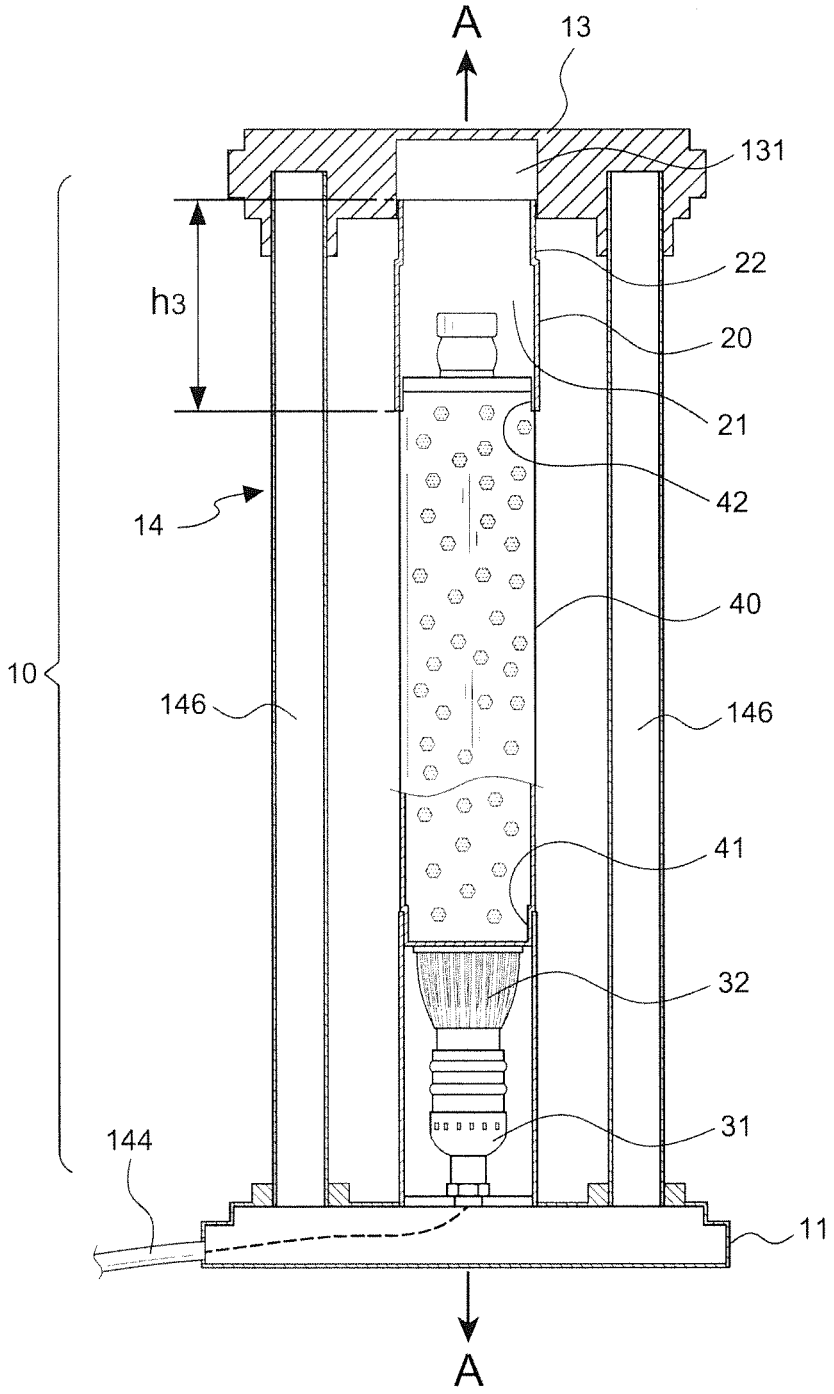
FIG. 8 is a sectional view of the last preferred embodiment in accordance with the present invention, illustrating in an assembly state.

FIG. 8 illustrates the last preferred embodiment that the support bracket 14 is composed of two vertical tubes 146 and includes a lower end fixed on the base 11 and an upper end fixed at a bottom of the second mounted seat 13 so that the centers of the first mounted seat 12 and second mounted seat 13 are vertically located on an axis A-A of the base 11. The joint sleeve 20 includes an inserted section 22 at an upper end thereof for inserting into the second containing room 131 of the second mounted seat 13 and an external diameter of the inserted section 22 is lightly smaller than an external diameter of a lower end of the joint sleeve 20. The joint sleeve 20 further includes a hollow containing room 21 at an inner periphery thereof and mounted on the upper end 42 of the transparent bottle 40 for securely positioning on the vertical axis A-A of the base 11. Due to the design of hollow containing room 21 of the joint sleeve 20, the transparent bottle 40 can be moved along the vertical axis A-A of the base 11 up and down for the transparent bottle 40 to be easily installed and removed between the first mounted seat 12 and second mounted seat 13.

Figure 9:
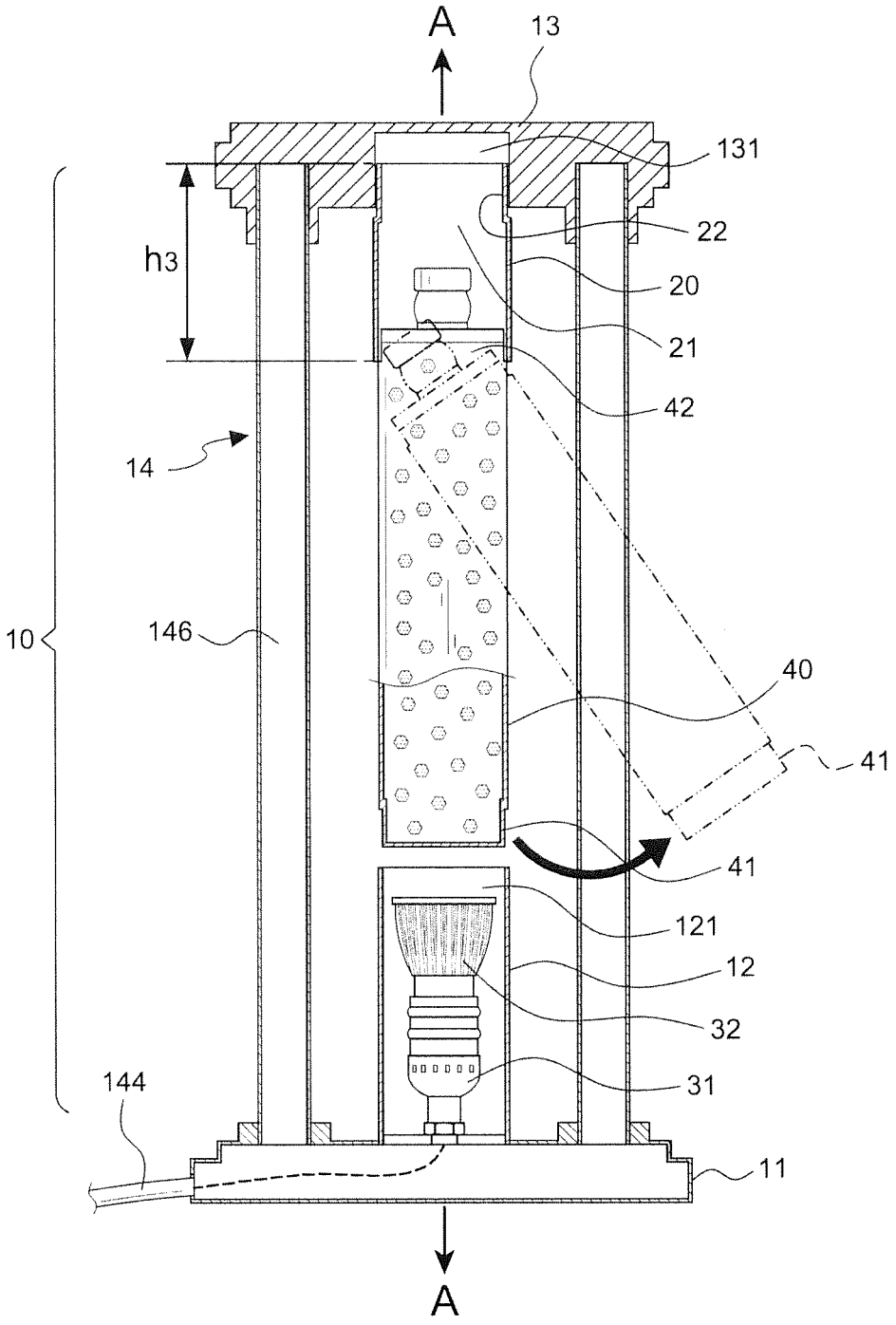
FIG. 9 is a schematic view of the last preferred embodiment in accordance with the present invention, illustrating a transparent bottle in a disassembly state.

FIG. 9 illustrates the disassembly of the transparent bottle 40. The first step is to axially move the transparent bottle 40 as well as the joint sleeve 20 upward until the inserted section 41 of the transparent bottle 40 detached from the first containing room 121 of the first mounted seat 12; the second step is to downward move the transparent bottle 40 at an angle until the transparent bottle 40 completely detached from the second mounted seat 13; the third step is to remove the joint sleeve 20 from the second containing room 131 of the second mounted seat 13. The user can follow to the first step to the third step in the reverse order to install the transparent bottle 40.

Based on the features disclosed, the present invention provides the liquid motion lamp holder improvement to avoid a transparent container overturning and falling apart which is able to harm human body by flowing-out liquid of the transparent container. The present invention further provides the LED bulb and liquid motion lamp transparent bottle that is easy to be installed and removed for increasing the convenience and security effects.

What is claimed is:

1. A stable holding structure for a liquid motion lamp, the holding structure comprising:

a holder having a base on a bottom thereof;

a first mounted seat having a bottom mounted on the base and a first containing room with an upward opening at an inner periphery thereof;

a second mounted seat arranged on a top of the holder and having a second containing room with a downward opening at an inner periphery thereof and the second containing room having a containing height of at least 5 cm;

a support bracket having an end connecting to a lower end of the holder and another end connecting to the second mounted seat for centers of the first mounted seat and second mounted seat to be vertically located on an axis of the base, being in an up-down corresponding state;

a projecting light source including a first lamp seat mounted in the first containing room of the first mounted seat and a bulb mounted on the first lamp seat;

a transparent bottle arranged between the first mounted seat and second mounted seat and having at least two immiscible substances therein and an inserted section at a lower end thereof and the inserted section having an external diameter slightly smaller than an external diameter of the transparent bottle; and at least a joint sleeve having a hollow containing room at an inner periphery thereof and mounted on an end of the transparent bottle and the transparent bottle having an upper end for moving upward to the second containing room to a predetermined height and the inserted section for moving downward to the first containing room and an extended height formed at an end of the transparent bottle by the joint sleeve so that the transparent bottle is securely positioned between the second containing room and first containing room;

whereby the transparent bottle turns into liquid motion lamp visual effect through the projecting light source; the design of the second containing room allows an end of the transparent bottle to be moved in the containing height along the vertical axis of the base up and down for the transparent bottle to be easily installed and removed between the first mounted seat and second mounted seat.

2. The stable holding structure for a liquid motion lamp as claimed in claim 1, wherein the bulb is an LED bulb.

3. The stable holding structure for a liquid motion lamp as claimed in claim 2, wherein the transparent bottle includes a bottom in contact with the top of the LED bulb for the heat of the LED bulb directly conducting to the bottom of the transparent bottle.

4. The stable holding structure for a liquid motion lamp as claimed in claim 3, wherein the joint sleeve is mounted on the bottom of the transparent bottle for inserting into the first containing room of the first mounted seat.

5. The stable holding structure for a liquid motion lamp as claimed in claim 4, wherein the joint sleeve includes an inserted section having a smaller diameter on a lower end of the joint sleeve for securely inserting into the first containing room of the first mounted seat.

6. The stable holding structure for a liquid motion lamp as claimed in claim 3, wherein the joint sleeve is mounted on a top of the transparent bottle for inserting into the second containing room of the second mounted seat.

7. The stable holding structure for a liquid motion lamp as claimed in claim 1, wherein the two immiscible substances include a solution mixed with calcium nitrate and water and a plurality of paillette having similar specific gravity with the solution.

8. The stable holding structure for a liquid motion lamp as claimed in claim 1, wherein the support bracket includes an end connected to the first mounted seat and an end connected to the second mounted seat.

9. The stable holding structure for a liquid motion lamp as claimed in claim 1, wherein the support bracket has an end connected to the base and an end connected to the second mounted seat.

10. The stable holding structure for a liquid motion lamp as claimed in claim 1, further comprising a second lamp seat and a lampshade arranged on a top of the second mounted seat and a lighting lamp is arranged on the second lamp seat.

* * * * *